US009022115B2

(12) United States Patent
Kleefisch et al.

(10) Patent No.: US 9,022,115 B2
(45) Date of Patent: May 5, 2015

(54) METHOD AND APPARATUS FOR WELLBORE PERFORATION

(75) Inventors: Mark Kleefisch, Plainfield, IL (US); Colin Hawthorn, Barrington, IL (US); Henry David Reynolds, Gurnee, IL (US); Neal Gregory Skinner, Lewisville, TX (US); Jim Basuki Surjaatmadja, Duncan, OK (US); Roger Lynn Schultz, Ninnekah, OK (US); Timothy Holiman Hunter, Duncan, OK (US)

(73) Assignees: Gas Technology Institute, Des Plaines, IL (US); Halliburton Energy Services, Inc., Houston, TX (US)

( * ) Notice: Subject to any disclaimer, the term of this patent is extended or adjusted under 35 U.S.C. 154(b) by 367 days.

(21) Appl. No.: 12/944,010

(22) Filed: Nov. 11, 2010

(65) Prior Publication Data

US 2012/0118568 A1 May 17, 2012

(51) Int. Cl.

| | |
|---|---|
| ***E21B 43/11*** | (2006.01) |
| ***E21B 7/14*** | (2006.01) |
| ***E21B 36/04*** | (2006.01) |

(52) U.S. Cl.

CPC . *E21B 43/11* (2013.01); *E21B 7/14* (2013.01); *E21B 36/04* (2013.01)

(58) Field of Classification Search

None

See application file for complete search history.

(56) References Cited

U.S. PATENT DOCUMENTS

| | | | | |
|---|---|---|---|---|
| 3,589,351 | A * | 6/1971 | Shoupp et al. | 125/1 |
| 6,880,646 | B2 | 4/2005 | Batarseh | |
| 7,487,834 | B2 * | 2/2009 | Reed et al. | 166/297 |
| 7,490,664 | B2 | 2/2009 | Skinner et al. | |
| 2004/0256103 | A1 | 12/2004 | Batarseh | |
| 2006/0144590 | A1 * | 7/2006 | Lopez de Cardenas et al. | 166/276 |
| 2008/0166132 | A1 * | 7/2008 | Lynde et al. | 398/142 |
| 2008/0314591 | A1 | 12/2008 | Hales et al. | |
| 2009/0272547 | A1 | 11/2009 | Dale et al. | |

* cited by examiner

*Primary Examiner* — Jennifer H Gay
*Assistant Examiner* — Caroline Butcher
(74) *Attorney, Agent, or Firm* — Pauley Petersen & Erickson

(57) ABSTRACT

A method for wellbore perforation in which a section of the wellbore to be perforated is isolated and purged of wellbore fluid to provide a clear path for laser beam transmittal. A laser beam emitter in the purged wellbore section transmits a laser beam pulse from the laser beam emitter to a target area of a sidewall and formation lithology of the purged wellbore section, thereby altering a mechanical property of a material of the sidewall and formation lithology and producing material debris. A liquid jet pulse of a liquid is transmitted immediately following termination of the laser beam pulse to the target area, thereby removing the material debris from the target area. This cycle is then repeated until the desired perforation depth has been achieved.

28 Claims, 2 Drawing Sheets

METHOD AND APPARATUS FOR WELLBORE PERFORATION

BACKGROUND OF THE INVENTION

1. Field of the Invention

This invention relates to a method and apparatus for perforating a wellbore. In one aspect, this invention relates to the use of laser energy for perforating wellbores. In one aspect, this invention relates to a method and apparatus for removal of solids generated during the wellbore perforation process. In one aspect, this invention relates to a method of providing a clear path for transmission of laser energy in a wellbore.

2. Description of Related Art

Once the drilling of a well has been completed, fluid flow into the well is initiated by perforation of the well casing or liner. Such perforations are created using shaped charges for establishing flow of oil or gas from the geologic formations into the wellbore. The perforations typically extend a few inches into the formation. However, there are numerous problems with this approach. First, the melt or debris from shaped charges usually reduces the permeability of the producing formations resulting in a substantial reduction in production rate. Second, these techniques involve the transportation and handling of high power explosives and are causes of serious safety and security concerns. Third, the energy jet into the formation also produces fine grains that can plug the pore throat, thereby reducing the production rate.

Additionally, other steps for initiating fluid flow may also be required, depending, at least in part, on the physical properties of the fluid in question and the characteristics of the rock formation surrounding the well. Fluid flow may be inhibited in situations involving highly viscous fluids and/or low permeability formations. Highly viscous fluids do not flow easily. As a result of the decreased rate of flow, efficiency is lowered and overall production rate decreases. The same is true for low permeability formations. In extreme cases, these factors reduce the flow rate to zero, halting production entirely.

Newer technologies have employed lasers to make perforations, but perforation depths have been limited to about 4 inches after which further penetration is hampered by hole taper issues and the lack of efficient debris removal. Hole taper occurs when a collimated laser beam is utilized because of the Gaussian beam shape distribution and attenuation of the laser beam with the debris column in the hole. The edges of the beam contain less irradiance than the center of the beam as a result of which, as the perforation gets deeper, the hole eventually comes to a point and the laser beam can no longer penetrate.

U.S. Pat. No. 6,880,646 to Batarseh teaches a method and apparatus for wellbore perforation using laser energy to heat a portion of the wellbore wall to a temperature sufficient to initiate a flow of fluid into the wellbore. However, there are no teachings regarding the effect of drilling fluid or other media in the wellbore on the transmission of the laser energy to the wellbore wall, nor are there any teachings regarding handling of any debris generated by the laser operation.

SUMMARY OF THE INVENTION

It is, thus, one object of this invention to provide a method and apparatus for wellbore perforation which addresses the effect of media in the wellbore on the laser energy transmission.

It is another object of this invention to provide a method and apparatus for wellbore perforation which provides for disposition of material debris generated by laser energy during the perforation process.

These and other objects of this invention are addressed by a method for wellbore perforation in which a wellbore section of a wellbore containing a wellbore fluid is isolated and the wellbore fluid disposed in the isolated section is purged from the wellbore section using a pressurized gaseous fluid, producing a purged wellbore section. A laser beam emitter provided to the purged wellbore section is used to transmit a laser beam pulse from the laser beam emitter to a target area of a sidewall of the purged wellbore section, thereby altering a mechanical property of a material of the sidewall and producing material debris. After termination of the laser beam pulse, at least one liquid jet pulse of a liquid is transmitted to the target area, thereby removing the material debris from the target area. In most instances, depending on the material undergoing perforation, a plurality of liquid jet pulses will be required to effectively dislodge and remove the material debris from the perforation target area before initiation of another laser beam pulse. After removal of the material debris, the process is repeated, i.e. a laser beam pulse followed by at least one liquid jet pulse, until the desired depth for the perforation has been achieved. It will be appreciated that, during the course of operation, some form of debris or liquid may find its way onto the optical window of the downhole tool containing the laser beam emitter through which the laser beam is transmitted to the target area, thereby impeding the laser beam. Accordingly, in accordance with one embodiment, a pressurized liquid jet, e.g. water, may be applied to the outer surface of the optical window to clear away such debris. In addition, a compressed gas jet may be applied to the outer surface of the optical window to remove any liquid or residual debris adhering to the window. Changes in the mechanical properties of the sidewall may result in removal processes including, but not limited to spallation and thermally induced stress fractures, phase changes, and thermally or photochemically induced chemical reactions. Preferred laser beam and liquid jet pulse durations in accordance with one embodiment of the method of this invention are in the range of about 2 seconds to about 90 seconds, depending upon the nature of the target lithology. The method of this invention is applicable to vertical, angled and horizontal wellbores.

The apparatus for executing the steps of the method of this invention comprises a power unit including a laser source with controlled power output; a compressed gas supply unit, pipelines from the compressor to a gaseous jet generation device, a nozzle for generating a gaseous cavity between the downhole tool and the wellbore wall, and a control system; a pressurized water or alternate liquid supply unit including pump, pipelines, water jet generation means and controls; an umbilical cable for delivering optical power, electrical power and control, and possibly required fluids, from above ground to the laser perforation tool located at wellbore depths up to about 5 km; means for deploying the tool, such as a coiled tubing unit, capable of delivering the laser perforation tool and umbilical cable comprising optical fibers, electrical power and control lines, and required fluid channels to the desired perforation zone depth within the wellbore; a laser perforation tool head, comprising packer elements, orientor, a pressure-sealed, thermally stabilized, clean environmental chamber housing optical components (fiber termination, beam steering, shaping, and focusing optics) with optically transparent exit window, electrical controls and sensors, and automated fluid purge controls, with external nozzles for supplying fluid for cleaning and conveying solids from the wellbore in addition to cleaning the external surface of the exit window; and a monitoring and operating computer to maintain the required sequence of operation to achieve the desired profiles of wellbore perforation.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

Figure 1:
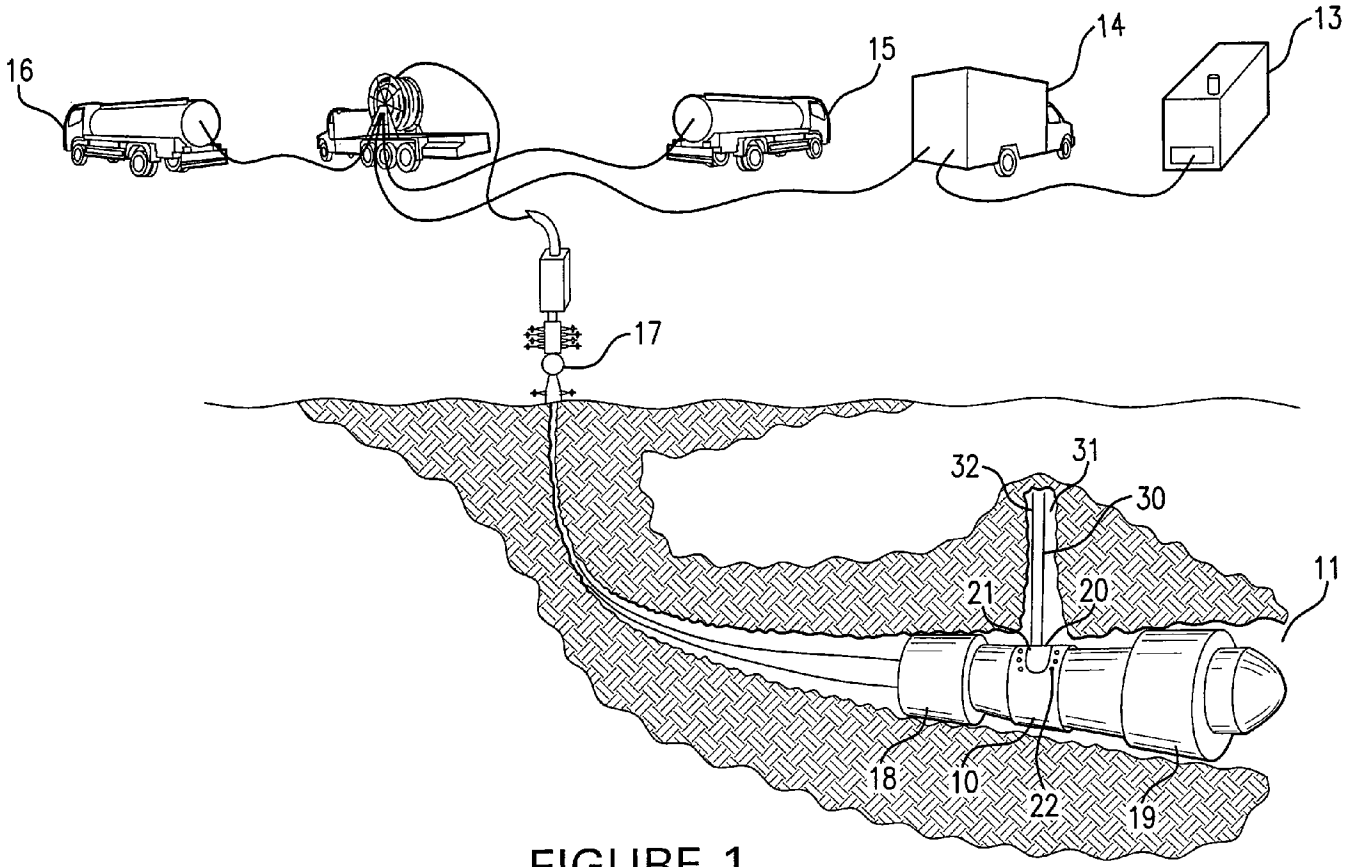
FIG. 1 is a schematic diagram of a system for wellbore perforation in accordance with one embodiment of this invention.

The primary steps of the method of this invention involve isolating a section of a wellbore containing a desired target area for perforation, purging the isolated wellbore section of any undesirable wellbore fluids, such as drilling fluid, providing a laser beam emitter in the isolated wellbore section, transmitting a laser beam pulse from the laser beam emitter to the desired target area for perforation resulting in alterations to the mechanical properties of the materials of the wellbore wall and/or underlying lithology and producing material debris, and removing the material debris from the target area using a liquid jet pulse. The sequence of transmission of the laser beam pulse followed by the application of one or more liquid jet pulses to remove material debris is repeated until the desired perforation depth has been achieved.

It will be appreciated that there are several operating parameters associated with the method of this invention including, but not limited to, laser beam irradiance, laser beam diameter, liquid jet pulse stream diameter, liquid flow rate, liquid stream velocity, surface absorption of the liquid, and laser beam and liquid jet pulse durations. It will also be appreciated that the operating parameters will vary depending upon the lithology of the target area for perforation, as a result of which the ranges of operating parameters are substantial. Without intending to be limited to any specific range of wellbore perforation applications, the method of this invention is particularly suitable for use at operational wellbore depths in the range of about 0.4 to about 5 km in wellbores having diameters in the range of about 6-12 inches for perforation of any gas or oil bearing formation, including, but not limited to, tight sands, sandstone, shale and carbonate rock lithologies.

Laser Beam Parameters

The laser beam parameters which may impact operation of the method of this invention include irradiance, laser beam diameter, optical fiber length, optical power at perforation target depth, surface laser power, laser wavelength, angle of incidence of the laser beam on the target area, and duration of laser beam pulses. The preferred irradiance in accordance with one embodiment of this invention is in the range of about 0.5 to about 10 kW/cm$^2$. However, it will be appreciated that the irradiance employed may be governed by a variety of considerations. For example, in limestone, higher irradiance results in a higher rate of perforation, but at a cost of higher power surface laser energy requirements or narrower laser beam/perforation. Laser beam diameter depends on the wellbore and downhole tool size, both of which limit the window/aperture size for the laser beam. The preferred range of laser beam diameters is about 0.5 to about 15 cm. The practical depth in the wellbore for perforation is limited by the losses incurred by the optical fiber. In particular, optical fibers exhibit a delivery loss of about 0.44 db/km of length. As a result, the practical optical fiber length is in the range of about 0.02 to about 10 km. Optical power at the perforation target depth is preferably in the range of about 3 to about 75 kW and, based upon at least a 50% loss through a 5 km optical fiber, the preferred surface laser energy power is in the range of about 5 to about 150 kW. Optical fiber delivery losses are affected, at least in part, by the wavelength of the laser. Preferred laser wavelengths in accordance with one embodiment of this invention are in the range of about 700 nanometers to about 1600 nanometers. Finally, the preferred angle of incidence of the laser beam on the target area is in the range of about 0 to about 45°.

Another parameter affecting the operation of the method of this invention is laser energy absorption. This parameter determines efficiency in heating rock material to effect spallation, melt, vaporization and/or chemical decomposition reactions in the rock material to be removed. Higher absorption is desirable, although some degree of reflection can be of use in controlling perforation geometry and limiting hole taper. The range of laser energy absorptivity is a material-dependant property that will also depend on (i) the wavelength of laser energy applied, (ii) surface roughness, (iii) angle of incidence, (iv) and water saturation. In addition, laser energy absorption may also typically start out lower and rise as a function of hole depth. As a result, it is difficult to define.

Of the incident laser energy impacting a target, a certain percentage is reflected away from the surface. Reflection coefficients for a given material can be calculated from the Fresnel Equations if the refractive index is known. For example, calcium carbonate ($Ca_2O_3$) has a refractive index of n=1.642 and, thus, a reflection coefficient of R=0.059 at a lasing wavelength of $\lambda$=1.07 microns and an angle of incidence of 0°. This calculation does not take into account material surface roughness. Reflectivity of a surface typically depends on surface roughness. When surface roughness is on a length scale smaller than incident laser energy, the surface tends to be a specular reflector. Otherwise, the material will diffusely reflect incident laser energy. Material surface roughness is dependent not only on the grain size of the rock lithology targeted, but also on the method of material removal. For example, laser perforations in limestone typically have smooth sidewalls, resulting from the nature of thermal decomposition that takes place to produce very fine powdery debris in the form of CaO. In contrast, laser perforations in sandstone that are formed via spallation processes can have more rugged sidewalls.

The liquid purge parameters which may affect the operation of the method of this invention include liquid medium, liquid stream diameter, liquid flow rate, liquid stream velocity and chemical composition. Any liquid medium compatible with the wellbore formation material may be employed. Suitable liquid media for use in accordance with the method of this invention include, but are not limited to, water, halocarbons, 7% wt KCl, and chemical additions, e.g. weak acids, surfactants, and the like, to assist in dissolution of the laser by-products. In accordance with one embodiment of this invention, the liquid stream diameter is in the range of about 0.02 to about 1.27 cm, the liquid flow rate is in the range of about 0.5 to about 200 liters per minute (lpm), and the liquid stream velocity is in the range of about 15 to about 1500 msec.

A schematic diagram of an apparatus for executing the steps of the method of this invention is shown in FIG. 1. The apparatus comprises a downhole tool 10 having components suitable for providing each of the laser beam pulses and fluid jet pulses required by the method as well as for isolating a section of the wellbore for perforation disposed in a wellbore 11. The downhole tool is connected with above ground sources of power 13, laser energy 14, purge gas 15 and water or other liquid 16 conveyed by way of suitable transmission conduits through a drill string or coiled tube 17 to the downhole tool. The downhole tool comprises first packer 18 and second packer 19 which are used for isolation of a section of the wellbore for perforation in accordance with the method of this invention, and orienting means for orienting the tool. The first and second packers operate in a conventional manner to isolate the section of the wellbore; however, at least one of the packers includes an opening through which fluids disposed within the isolated section of the wellbore as well as debris generated during the perforation process are able to be expelled from the isolated section. Alternatively, the packers are inflatable devices, in which case at least one of the packers may be selectively inflated and deflated to allow for passage of debris. Disposed within the downhole tool between the spaced apart packers are a laser beam emitter 20 from which a laser beam 30 is transmitted to produce a perforation 31, a water source 21 suitable for providing a water jet stream 32 to the target area for perforation, and a gaseous fluid source 22 for providing a purge gas, such as nitrogen, for purging the isolated section of the wellbore of undesirable fluids so as to provide a clear path for transmission of the laser beam from the laser beam emitter to the target area for perforation. It will be appreciated that liquids other than water, such as halocarbons and KCl, may be employed for removing debris, and such other liquids are deemed to be within the scope of this invention. To prevent the expelled undesirable fluids from reentering the isolated section of the wellbore, an overbalanced condition is maintained within the isolated section of the wellbore.

The laser beam emitter in accordance with one embodiment of this invention comprises at least one optical fiber or optical fiber bundle connected with the above ground laser energy source 14 through which laser energy is transmitted from the laser energy source to the laser beam output end of the optical fiber or optical fiber bundle. Laser beam assemblies suitable for use in the downhole tool are known to those versed in the art. See, for example, U.S. Pat. No. 6,880,646 discussed herein above. The downhole tool further comprises at least one purge gas nozzle through which the purge gas is introduced into the isolated section of the wellbore and at least one water jet nozzle through which water jet pulses are provided to the target area for perforation for removal of debris generated during the perforation process. Equally important as maintaining an overbalanced condition within the isolated section of the wellbore for maintaining a clear transmission path between the laser beam emitter and the target area is preventing the accumulation of debris and liquids on the window of the downhole tool through which the laser beam is transmitted to the target area. This may be achieved using a gaseous fluid nozzle directed toward the outer surface of the window through which a gaseous fluid is transmitted to the window prior to and/or during each laser beam pulse.

Feasibility of the method of this invention has been demonstrated in a series of experiments which explored laser beam irradiance levels, divergence angles, exposure times and cycle times, in conjunction with a fixed pressure water jetting sequence. Deep, high aspect ratio perforations were able to be performed using the method of this invention.

Example

In this example, a 1750 psi water jet was determined to be sufficient to remove thermally spalled debris and melt from a sandstone target without removing the underlying virgin material not previously subjected to significant optical power levels. A persepex water containment vessel was positioned above a secondary water containment vessel on the top of an optical bench. A Berea sandstone target was placed on a lab jack within the water containment vessel. The target was aligned to the laser input to the chamber by use of a visible guide beam delivered by an optical head comprising a QBH-fiber terminal, collating optics, focusing lens and protective window. A 300 mm focusing lens was installed such that a diverging beam could be projected with adequate spot size onto the target face to attain desired beam irradiance with 4 kW total laser power, and to provide adequate standoff from the target to avoid splash back of debris. A ball valve was inserted after the pressure washer so it could be easily cycled on and off. The laser was then turned on and off, repeatedly. It was turned on for 4 seconds at 100% power and then turned off to accommodate a high velocity water jet blast. Impingement of the high velocity water jet was sufficient to rapidly eject the irradiated portion of Berea Sandstone from the target. The portion of the opening or hole proximate the laser energy emitter produced in this manner measured 33 mm in diameter. The portion of the opening or hole distal from the laser beam emitter was larger than the front portion of the whole due to the diverging laser beam used in this experiment. The laser head was maintained at a fixed standoff distance from the hole. The water jet provided improved hole cleaning and reduced hole taper as compared to laser perforation techniques reliant upon gas purge jets. The sample was sectioned to enable observation of the hole geometry and features. The narrow stream of high-pressure water allowed conveyance of solids from the back of the hole. The specific energy result was very similar to spallation at 8.9 kJ/cc but not as high as would be expected when trying to melt the sample. The rate of perforation was 3.5 cm/min, calculated on the basis of laser time on only and not when the water jet was on or with the time it took to reset the laser.

Beam Diameter Tests

To further evaluate the alternating laser/water jetting method of this invention for penetrations with a length over diameter L/D aspect ratio larger than 6, beam diameter tests were conducted with constant beam irradiance. The tests consisted of a diverging laser beam produced by a 344 mm focal length lens in the optical head, with a co-axial air-knife through a copper cone aperture providing optics protection. A pressure washer (AR North America, Model AR240, 1750 maximum psi, maximum flow rate of 1.5 GPM, maximum temperature of 122° F.) and zero degree washer nozzle (Spraying Systems T003), fixed to the laser head facilitated high-pressure water purging of laser perforations. Pressure at the nozzle was calculated to be about 1000 psig. A fixed 600 psig (regulator) $N_2$ purge was included with delivery via 1.58 mm I.D. stainless steel tube to enable nitrogen purging at the end of pulse cycles to dry out the perforation prior to the next laser pulse. The laser head was positioned to generate the required beam spot size on the front face of a limestone target with variation between 20 mm-28 mm obtained. Optical parameters for each of the beam diameter setups are shown in Table 1.

TABLE 1

Optical Parameters for Beam Diameter Tests

| Beam Diameter, mm | Target Standoff from F = 344 mm lens, mm | Laser Power, kW | Irradiance, kW/cm$^2$ |
|---|---|---|---|
| 20 | 590 | 2.1 | 0.66 |
| 24 | 640 | 3 | 0.66 |
| 28 | 688 | 4 | 0.65 |

Figure 2:
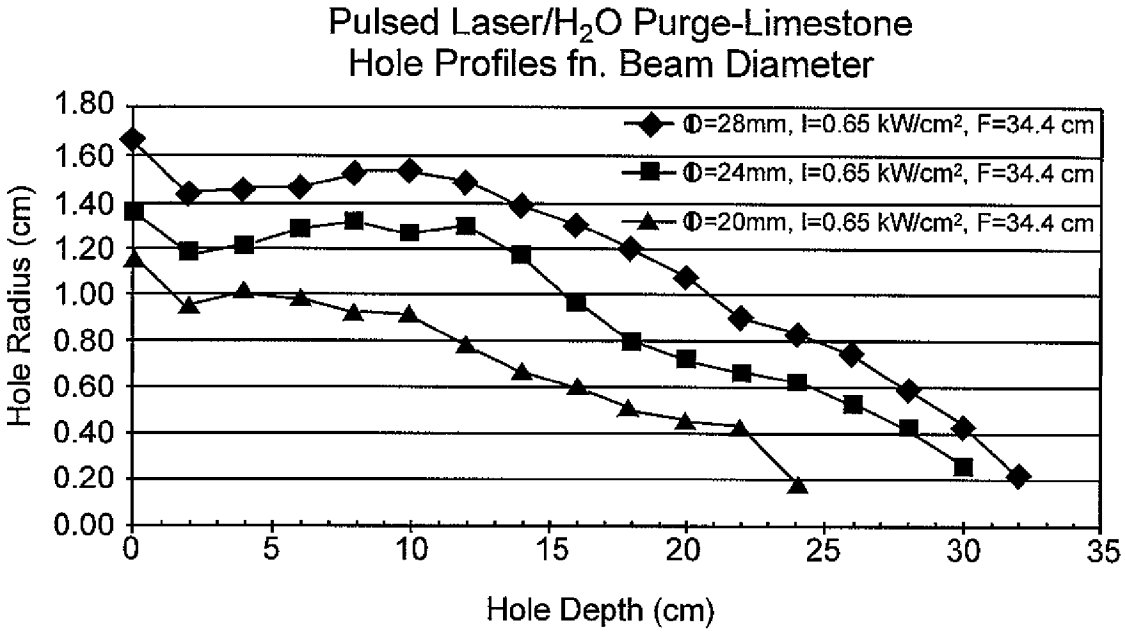
FIG. 2 is a diagram showing perforation radius and perforation depth as a function of laser beam diameter for a limestone target material.

An irradiance of about 0.65 kW/cm$^2$ was maintained between all beam diameter shots. Higher beam irradiances will enable shorter laser on times. The 28 mm diameter beam utilized the full 4 kW of the laser system, with the 24 mm and 20 mm spot sizes on the front face utilizing 75% and 50% power settings, respectively. A 12 second laser pulse duration, followed by 5 water jet pulses, each of 3 seconds duration, and a final 5 sec $N_2$ purge was utilized for each automated pulse cycle. Testing started with a single 3 sec water purge; however, the samples cracked. To ensure target integrity, water volume was increased to improve the cooling effect. Nitrogen purge was instituted in an attempt to clear the hole of moisture before cycling the laser. $N_2$ purge times of about 5 seconds to clean the window before the laser turns on worked well. A hydrophobic window surface could shorten the time to as short as 0.5 seconds. The limestone targets employed in these tests measured 6"×6"×24" in dimension. Perforations were terminated at a point where minimal depth increase was noted after several runs, each of 10 cycles. Once a test was terminated, the target was longitudinally sectioned in the vertical plane with a rock saw. Hole dimensions were measured at 20 mm increments along the length of the perforation. Larger diameter holes were determined to allow deeper holes because there is more efficient hole cleanup for debris removal. See FIG. 2.

Normally, laser energy can destabilize a rock surface, however it is difficult to remove the destabilized solids from the hole, as a result of which laser perforation depth is limited to about 3 to 4 inches. The method and apparatus of this invention provide effective line of sight for laser perforating in the downhole environment and also provide a means to effectively remove unstable solids from the perforation hole by pressurized water/liquid jets to expose fresh perforation surfaces. In addition, the method and apparatus of this invention maintain laser optical surfaces clean in a dirty environment by, in a synchronized fashion, allowing water to purge over the optical window when the laser beam is off and allowing a gas purge over the optical surface before and during the laser on times to eliminate condensation on the optical surfaces that will interfere with the laser energy to target. These steps are synchronized with the laser on/off times and the water jet on/off times to maximize laser energy to the perforation.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A method for wellbore perforation comprising the steps of:

a) purging wellbore fluid from a wellbore section of a wellbore using a pressurized gaseous fluid, producing a purged wellbore section;

b) providing a laser beam emitter in said purged wellbore section;

c) transmitting a laser beam pulse from said laser beam emitter to a target area of a sidewall of said purged wellbore section, thereby altering a mechanical property of a material of said sidewall, forming a perforation with a hole taper and producing material debris;

d) jetting a pulse of a liquid along an axis of penetration of the laser beam pulse following termination of said laser beam pulse to said target area, thereby reducing said hole taper and removing said material debris from said target area and exposing an underlying virgin material not previously subjected to significant optical power levels; and e) following termination of the pulse of liquid, spraying a pressurized gas to the target area to remove moisture from the target area and repeating steps c) and d) to remove the underlying virgin material until a desired perforation depth has been achieved.

2. The method of claim 1, wherein at least one of chemical and mechanical isolation means are provided for isolating said wellbore section from a remaining portion of said wellbore.

3. The method of claim 1, wherein a plurality of additional said liquid jet pulses are transmitted to said target area, each said liquid jet pulse following termination of a previous liquid jet pulse.

4. The method of claim 1 further comprising impacting at least one of a compressed gas stream and a pressurized liquid stream on an optical window through which said laser beam pulse is transmitted to said target area, thereby cleaning said optical window prior to said transmitting of said laser beam pulse to said target area.

5. The method of claim 4, wherein steps c) and d) are repeated until a desired wellbore perforation depth has been achieved.

6. The method of claim 1, wherein said laser beam pulse has a duration in a range of about 0.5 seconds to about 30 seconds.

7. The method of claim 1, wherein said at least one liquid jet pulse has a duration in a range of about 2 seconds to about 90 seconds.

8. The method of claim 1, wherein said wellbore section is isolated using an upper packer and a lower packer above and below, respectively, said wellbore section.

9. The method of claim 1, wherein said liquid comprises a fluid selected from the group consisting of halocarbons, KCl, acids, surfactants, and water.

10. A method for perforating a wellbore comprising the steps of:

isolating a wellbore section in a wellbore between a first packer and a second packer, producing an isolated wellbore section;

introducing a compressed gas into said isolated wellbore section, creating a gaseous cavity between said first packer and said second packer;

providing a laser beam emitter in said gaseous cavity;

transmitting at least one laser beam pulse from said laser beam emitter to a target area of a wellbore sidewall section between said upper packer and said lower packer, altering at least one mechanical property of a wellbore sidewall material, forming a perforation with a hole taper and producing material debris;

transmitting at least one pulse of a liquid jet along an axis of penetration of the laser beam pulse to said target area following termination of said laser beam pulse, resulting in removal of said hole taper and said material debris from said target area and exposing an underlying virgin material not previously subjected to significant optical power levels; and following termination of the liquid jet, spraying a pressurized gas to the target area to remove moisture from the target area;

transmitting a second laser beam pulse from said laser beam emitter to the underlying virgin material and producing material debris from the underlying virgin material; and following termination of the second laser beam pulse, transmitting a second pulse of the liquid to remove the material debris from the underlying virgin material.

11. The method of claim 10, wherein each of said laser beam pulses is followed by a plurality of said liquid jet pulses.

12. The method of claim 10 further comprising transmitting at least one of a compressed gas stream and a pressurized liquid stream to impact on an optical window through which said at least one laser beam pulse is transmitted to said target area, thereby cleaning said optical window prior to each transmitting of said laser beam pulse.

13. The method of claim 10, wherein said laser beam pulse has a duration in a range of about 2 seconds to about 90 seconds.

14. The method of claim 10, wherein each said pulse of said liquid jet has a duration in a range of about 0.5 seconds to about 30 seconds.

15. The method of claim 10, wherein a plurality of said pulses of said liquid jet are transmitted to said target area following each said laser beam pulse.

16. The method of claim 10, wherein said liquid jet comprises a fluid selected from the group consisting of halocarbons, KCl, acids, surfactants, and water.

17. A method for wellbore perforation comprising the steps of:

a) one of chemically and mechanically isolating a section of a wellbore containing a wellbore fluid;

b) purging said wellbore fluid from said section using a pressurized gaseous fluid, producing a purged wellbore section;

c) providing a laser beam emitter in said purged wellbore section;

d) impacting a laser beam pulse from said laser beam emitter on a target area of a sidewall of said purged wellbore section, thereby altering a mechanical property of a material of said sidewall, forming a perforation with a hole taper and producing material debris;

e) jetting a liquid jet pulse along an axis of penetration of the laser beam pulse following termination of said laser beam pulse on said target area, thereby reducing said hole taper, removing said material debris from said target area and exposing an underlying virgin material not previously subjected to significant optical power levels; and f) following termination of the liquid jet pulse, spraying a pressurized gas to the target area to remove moisture from the target area and repeating steps d) and e) to remove the underlying virgin material until a desired perforation depth has been achieved.

18. The method of claim 17, wherein a plurality of said liquid jet pulses are impacted on said target area following each said laser beam pulse.

19. The method of claim 17, wherein a plurality of said laser beam pulses, each followed by at least one liquid jet pulse, are impacted on said target area.

20. The method of claim 17 further comprising impacting at least one of a compressed gas stream and a pressurized liquid stream on an optical window through which said at least one laser beam pulse is transmitted to said target area, thereby cleaning said optical window prior to said impacting of said laser beam pulse on said target area.

21. The method of claim 17, wherein said laser beam pulse has a duration in a range of about 2 seconds to about 90 seconds.

22. The method of claim 17, wherein each said pulse of said liquid jet has a duration in a range of about 0.5 seconds to about 30 seconds.

23. A method for perforating a wellbore comprising the steps of:

a) providing a wellbore perforation apparatus to a desired depth in said wellbore at a distance from a wellbore wall, said apparatus comprising laser beam emission means for emitting a laser beam;

b) creating a gaseous cavity within said wellbore;

c) transmitting a pulse of said laser beam to said wellbore wall, creating a laser-induced mechanical property change in said wellbore wall, producing material debris and fowling a perforation area with a hole taper; and d) providing at least one pressurized liquid pulse of a liquid along an axis of penetration of the laser beam pulse following termination of said pulse of the laser beam to said perforation area until said hole taper and said material debris is removed from said perforation area and exposing an underlying virgin material not previously subjected to significant optical power levels; and e) following termination of the pressurized liquid pulse, spraying a pressurized gas to the target area to remove moisture from the target area and repeating steps c) and d) to remove the underlying virgin material until a desired perforation depth has been achieved.

24. The method of claim 23, wherein said gaseous cavity is created by introducing a pressurized gas between a pair of spaced apart packers disposed in said wellbore.

25. The method of claim 23, wherein said liquid comprises a fluid selected from the group consisting of halocarbons, KCl, acids, surfactants, and water.

26. The method of claim 23, wherein a stream diameter of said liquid is in a range of about 0.02 to about 1.27 cm.

27. The method of claim 23, wherein a flow rate of said liquid is in a range of about 0.5 to about 200 lpm.

28. The method of claim 23, wherein a stream velocity of said liquid is in a range of about 15 to about 1500 m/sec.

* * * * *